US006203107B1

(12) United States Patent
Jonsson

(10) Patent No.: US 6,203,107 B1
(45) Date of Patent: Mar. 20, 2001

(54) CHAIR

(75) Inventor: Bertil Jonsson, Sjalevad (SE)

(73) Assignee: Jonber, Inc., Jacksonville, FL (US)

( * ) Notice: Subject to any disclaimer, the term of this patent is extended or adjusted under 35 U.S.C. 154(b) by 0 days.

(21) Appl. No.: 09/414,919

(22) Filed: Oct. 9, 1999

Related U.S. Application Data

(63) Continuation-in-part of application No. PCT/US99/19071, filed on Aug. 20, 1999.

(30) Foreign Application Priority Data

Sep. 10, 1998 (SE) ..... 9803082

(51) Int. Cl.[7] ..... A47C 1/023
(52) U.S. Cl. ..... 297/337; 297/312; 297/330
(58) Field of Search ..... 297/284.1, 312, 297/313, 322, 330, 337, 338, 339, 344.15, 344.16

(56) References Cited

U.S. PATENT DOCUMENTS

| | | | | |
|---|---|---|---|---|
| 4,744,603 | | 5/1988 | Knoblock . | |
| 4,773,706 | | 9/1988 | Hinrichs . | |
| 4,830,431 | | 5/1989 | Inoue . | |
| 4,938,531 | | 7/1990 | Fogarassy . | |
| 5,112,018 | * | 5/1992 | Wahls | 297/339 |
| 5,249,829 | | 10/1993 | Faiks et al. . | |
| 5,316,370 | * | 5/1994 | Newman | 297/313 |
| 5,553,920 | * | 9/1996 | Meschkat et al. | 297/344.14 |
| 5,556,163 | * | 9/1996 | Rogers, III et al. | 297/337 X |
| 5,564,783 | | 10/1996 | Elzenbeck et al. . | |
| 5,658,045 | | 8/1997 | Van Koolwijk et al. . | |
| 5,664,834 | | 9/1997 | Hsu . | |
| 5,692,802 | * | 12/1997 | Aufrere et al. | 297/337 |
| 5,755,488 | * | 5/1998 | Beda et al. | 297/337 |
| 5,775,774 | | 7/1998 | Okano . | |
| 5,797,653 | | 8/1998 | Elzenbeck et al. . | |
| 5,826,940 | | 10/1998 | Hodgdon . | |

FOREIGN PATENT DOCUMENTS

| | | | | |
|---|---|---|---|---|
| 629 334 | * | 11/1927 | (FR) | 297/338 |

* cited by examiner

*Primary Examiner*—Peter R. Brown
(74) *Attorney, Agent, or Firm*—Fasth Law Offices; Rolf Fasth

(57) ABSTRACT

A chair that includes a frame and a seat disposed there above, and an upwardly protruding back support that is located in an area behind the seat. A front part of the back support has a lumbar support device that is disposed a certain level above the seat to support the lumbar spine and/or pelvis rim of the user. The seat is movable relative to the frame between the forward starting position, on the one hand, in which the seat is remote from the back support and is the normal position when the seat is not used by a sitting person and a rear end position, on the other hand, has a lumbar support in which the seat has moved closer to the back support. More particularly, it is closer for the purpose of bringing the pelvis of the person sitting on the seat to partially shift in against or below the lumbar support device.

23 Claims, 10 Drawing Sheets

FIG. 12
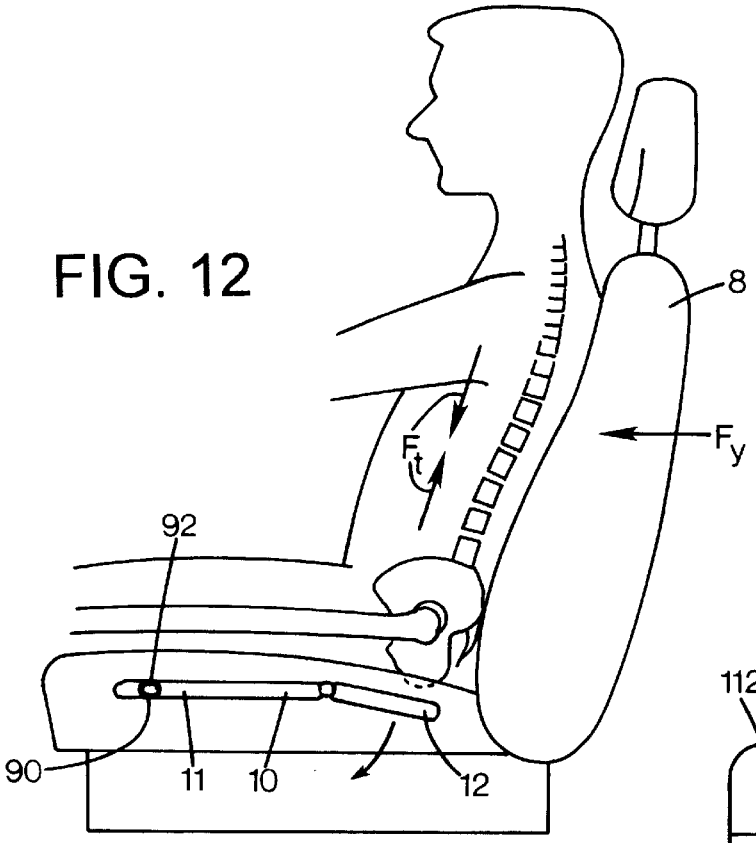
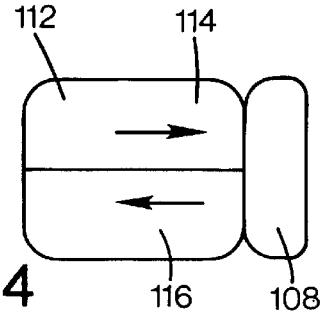
FIG. 14
FIG. 13
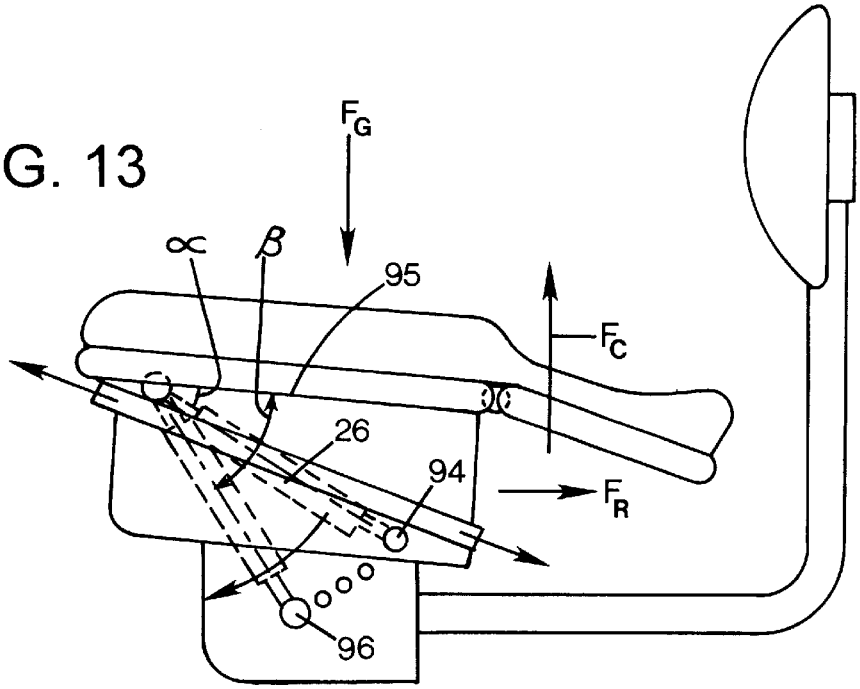

CHAIR

PRIOR APPLICATION

This is a continuation-in-part application of PCT Application No. PCT/US99/19071, filed Aug. 20, 1999.

TECHNICAL FIELD OF THE INVENTION

The invention relates to a chair that includes a frame, a seat that is disposed above the frame and an upwardly protruding back support that is disposed behind the seat. The back support has a lumbar support device disposed a certain level above the seat to support the user's lumbar spine and/or the pelvis rim. The seat and the frame are movable relative to one another between a first and a second end position.

BACKGROUND AND SUMMARY OF THE INVENTION

Chairs that are used for a variety of purposes, such as office chairs, chairs for home use, vehicle chairs or seats etc. sometimes include a special lumbar support device to support the lumbar spine of the user. Usually this device is a softly rounded protrusion or cushion that is disposed on the front of the back support and a certain level above the seat. Below this protrusion, the person sitting on the seat may push in his pelvis until the protrusion bears against the lower back so that the lower back is in an ergonomically desirable, sway-backed or bow shaped position.

Although earlier known chairs (see, for example, U.S. Pat. No. 1,836,630) have an ergonomical shape that theoretically provide a good support for the lumbar spine, there is no guarantee that the user is really going to take advantage of the possibilities of the chair with regards to the entire potential of the back support to support the back in a physiologically optimal way. An optimal use requires that the user of the chair is required to intentionally push back the his bottom into the area below the lumbar support device. For various reasons, such as forgetfulness, stress, laziness or negligence, the user often does not push in the bottom against the part of the back support that is positioned below the sway back supporting protrusion. The result is that there is a gap between the bottom and the back support, so that the sway-back position of the back bone is mediocre. In other words, the body posture of the user becomes wrong and tiresome which can easily create back pain.

One object of the present invention is to solve the above-mentioned problems associated with the earlier known chairs as mentioned above and to create an improved chair. A fundamental purpose of the invention is thus to create a chair that ensures a complete support of the user's back against the lumbar support of the back support without requiring the user to intentionally push in the bottom against the lower part of the back support that is situated below the lumbar support device. Another object is to create a chair that permits a wide variety of user functions. More particularly, the required pushing in of the bottom may be accomplished automatically or with a motor force.

Yet another object is to create a chair that prevents the tendency of users that sit on the seat to slide forwardly along the seat of the chair. In other words, the construction of the chair is such that the person sitting on the chair maintains his bottom in contact with the lower part of the back support in a lasting reliable way.

WO-A-97/10735 describes a chair that has a seat and a back support that are generally movable towards or away from one another. The purpose of the movability between the seat and the back support is to achieve a pressure reduction on the user's bottom and lumbar spine that can be accomplished be forming a recess in the area between the rear edge of the cushion included in the seat and the back support that is disposed behind the seat. In this case, however, the seat is arranged to be locked into set positions after a the seat or the cushion have been moved to a desired position.

The known chair includes, therefore, no means for handling the three functions depending upon whether the user is sitting on the chair or is leaving the same, namely to hold the seat in the starting position, to activate a relative movement between the seat and back support when the user sits down on the seat, and to activate the return of the seat to the starting position when the user leaves the seat, as is stipulated in the present invention.

U.S. Pat. No. 5,244,252 discloses a vehicle seat that is movable between front and rear end positions. In this case, however, the seat is movable in a rock like manner along a bow shaped path which a central point situated above the seat. When the user sits down on the seat, the seat can move in a forward direction towards a front end position. In other words, this chair does not include means for moving the seat and the back support in a clear and controlled manner towards one another with the purpose of pushing the back of the user against the lumbar support device disposed behind thereof without requiring the user to have to take special, intentional steps therefor.

The chair of the present invention is comfortable and easy to adjust to the specific needs of the user. The chair also provides good support for the back of the user. The user of the chair may also move within the chair without losing the good support of the back of the user.

BRIEF DESCRIPTION OF THE DRAWINGS

FIG. 12 is a side view of a fourth embodiment of the chair of the present invention;

FIG. 13 is a cross sectional side view of the first embodiment of the chair; and FIG. 14 is a top view of a fifth embodiment of the seat.

DETAILED DESCRIPTION

Figure 1:
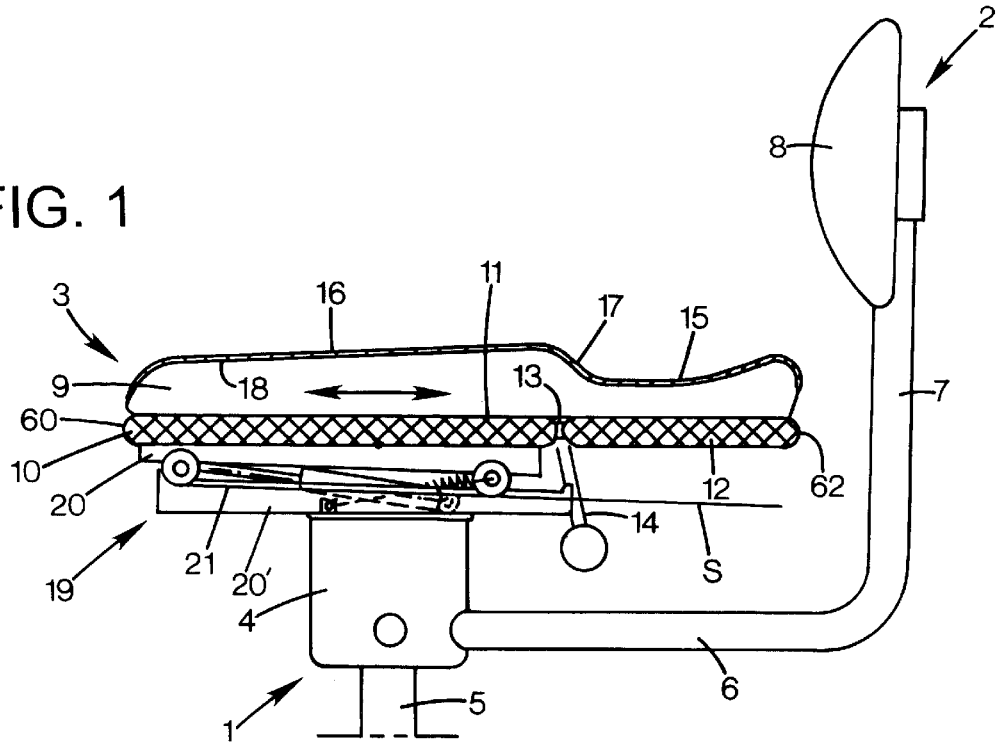
FIG. 1 is a schematic, partly cross-sectional side view showing the chair according to the invention, wherein a support panel that is included in the seat of the chair is shown in a first functional position.
Figure 2:
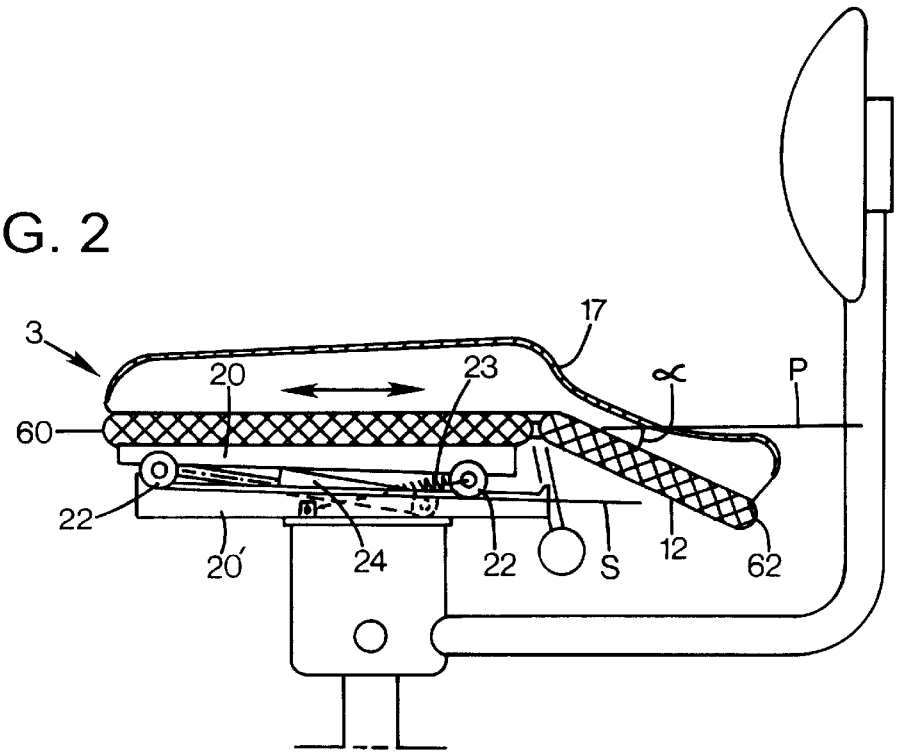
FIG. 2 is an analog side view showing the support panel of the seat in a second functional position.
Figure 3:
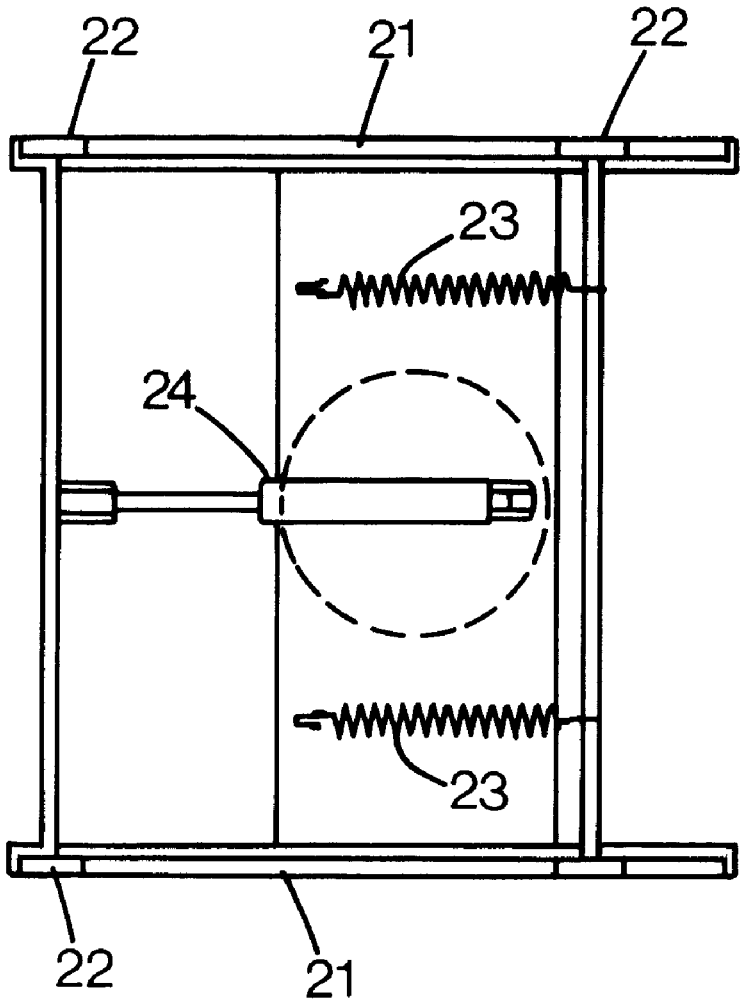
FIG. 3 is a bottom view of the chair seat according to FIGS. 1–2.

The chair shown in FIGS. 1–3 includes a frame that as a whole is referred to with the reference numeral 1, a back support 2 and a seat generally referred to with 3. This chair is exemplified in the form of an office chair which frame 1 includes a cylinder shaped support 4 that is disposed on a member 5 that may be attached to a support having wheels (not shown). The back support 2 has a protrusion 6 that extends from the support 4 and transforms, at its rear end, to a vertical post 7 on which a lumbar support device 8 is mounted. The device 8 is preferably a soft pillow that has a curved front surface.

Preferably, the seat 3 includes an upper soft cushion 9 and a lower support panel generally indicated with the reference numeral 10. The support panel 10 includes a front part 11 and a back part 12. Of these parts, the front part may be mounted to a member 19 that is included in the frame 1. The construction and function of the member 19 will be described below. The member 19 is mounted on and is supported by the cylindrical support 4.

As is clearly shown in FIG. 1, the back part 12 protrudes backwardly as a free end from the rear edge of the front part 11 and the back part 12 does not have any direct contact with the back support 2. Therefore, the back support is attached to the frame 1 which in turn is attached to and supported by the front part 11 of the seat, but not the back part 12. This means that the back part is vertically movable relative to the back support. In the embodiment illustrated in FIG. 1, the vertical movement may be realized because the back part 12 is rotatable or swingable relative to the front part 11.

It has been contemplated that the back part 12 may be rigidly formed and attached to the front part 11 with one or many mechanical hinges 13 so that both parts are lockable relative to one another at a desired angle with the assistance of a locking mechanism that is not shown in detail but is indicated as a lever 14. In practice, the rear part 12 may be swingable between an upper starting position in which the rear part 12 is situated as a linear extension of the front part 11, that is, in one and the same horizontal plane as the front part 11 and the rear part 12 may also be disposed in a turned down position, as shown in FIG. 2, to form a rotational angle alpha. The maximum rotational angle is preferably between 50–60 degrees. Although the rotational angle alpha is shown at about 25 degrees in FIG. 2, an angle at about 45 degrees is preferred in practice.

As best shown in FIGS. 1 and 2, the rear part 12 may be shorter than the front part 11. In practice, the length of the rear part 12 should be about 20–50%, preferably, 20–40% of the whole length of the support panel 10 between the opposite, front and rear end edges, 60, 62, respectively.

Both parts 11, 12 of the support panel 10 may be made of suitable materials that are of a rigid nature such as plastic, metal or wood (such as plywood). The softer cushion that may be laid on top of the support panel 10 may also be made of a variety of materials that should have the characteristic of being elastically resilient to provide sit comfort. In practice, it is preferable to use foam rubber.

A rear seat area 15 of the cushion 9 may be recessed relative to a front sear area 16 that may take up the rest of the cushion 9. In this way, the rear seat area 15 may transformed to the front seat area 16 via an upwardly protruding transformation surface 17 that forms a counter point against which the user's tuber ischii may rest in order to prevent a forward sliding of the thigh bones along the seat and also to prevent a backward rotation of the pelvis. Preferably, the transformation surface 17 is situated in an area that is vertically above or closely behind the hinge 13 disposed between the rear and front parts 11, 12 of the support panel 10. This means that the front and rear seating areas 16, 15 of the cushion 9 have substantially the same length as the front part 11 and the rear part 12, respectively. Difference in levels between the seat areas 15 and 16 may vary but should in practice be in the interval 1–40 millimeters, preferably 5–30 millimeters.

Preferably, the upper side or the outside of the cushion 9 should, at least partially, be covered with a cover 18 that has the feature of creating a resistance to sliding in a forward direction towards the end edge 60 along the cushion 9 but not in the opposite direction. Plush fabric may be used for this purpose that has fiber elements pointing in a backward direction. As explained in detail below, this feature is useful to prevent the bottom of the person sitting on the cushion from sliding forward which may put extra strain on the back of the person.

With the help of a special member, the seat 3 is movable relative to the frame between a forward starting position, on the one hand, in which the seat is at a maximum distance from the back support 2. The forward starting position is the normal position of the seat when nobody is sitting on it. On the other hand, the seat may be moved to a rear end position in which the seat is closer to or adjacent to the back support 2. More particularly, rear end position has one purpose of partially pushing the user's pelvis against or under the lumbar support device 8 of the back support 2. The movements of the seat 3 between the forward and rear end positions may be done in along a substantially horizontal plane P although a pronounced slanting plane of movement is possible.

With reference to the embodiments shown in FIGS. 1–3, the member 19 may be arranged for the above mentioned movements of the seat. This member may include a first upper unit 20 that is associated with the support panel 10 of the seat, more particularly, the front part 11 and an other unit 20' that is associated with the frame 1 and more particularly the cylinder shaped support 4. The lower unit 20' preferably includes a sliding plane that at least partially slopes in a general rearward/downward direction relative the horizontal plane P.

In the embodiments shown, this sliding plane S may be realized in the form of straight tracks 21 (also see FIG. 3) and a pair of wheels 22 that are movable therealong. The wheels 22 are preferably rotatably attached to the unit 20. Because the tracks 21 are sloping in the rearward/downward direction along the sliding plane S relative to the horizontal plane P, the seat may, similar to a cart, roll in the backward direction towards the back support 2 when a user sits on the seat 3. It should from the above description be understood that the unit 20' may be stationary while the unit 20 may be movable.

In order to bring back the seat 3 to the unloaded forward starting position that is the forward end position of the starting position, one or many springs 23 may be used that has one end attached to the stationary unit 20' and the opposite end is attached to the movable unit 20.

In the preferred embodiment, the member 19 includes a device to delay the initialization of the movement of the seat 3 towards the rear end position for a certain time period after the user has sat down on the seat 3. In the embodiments illustrated, this device may be a pneumatic or hydraulic piston 24 which has opposite ends that are connected with the stationary units 20, 20', respectively. The velocity of the protrusion of the pistons out of the cylinders may be at a maximum of 50 millimeters/minute. However, higher velocities are possible. By using the piston, it is ensured that the user is not uncomfortable because the seat immediately and quickly moves from the original forward position to the rear end position as soon as he sits on the seat 3 because the resistance of the piston 26 ensures a slow and controlled movement of the seat in the direction towards the rear end position.

Figure 4:
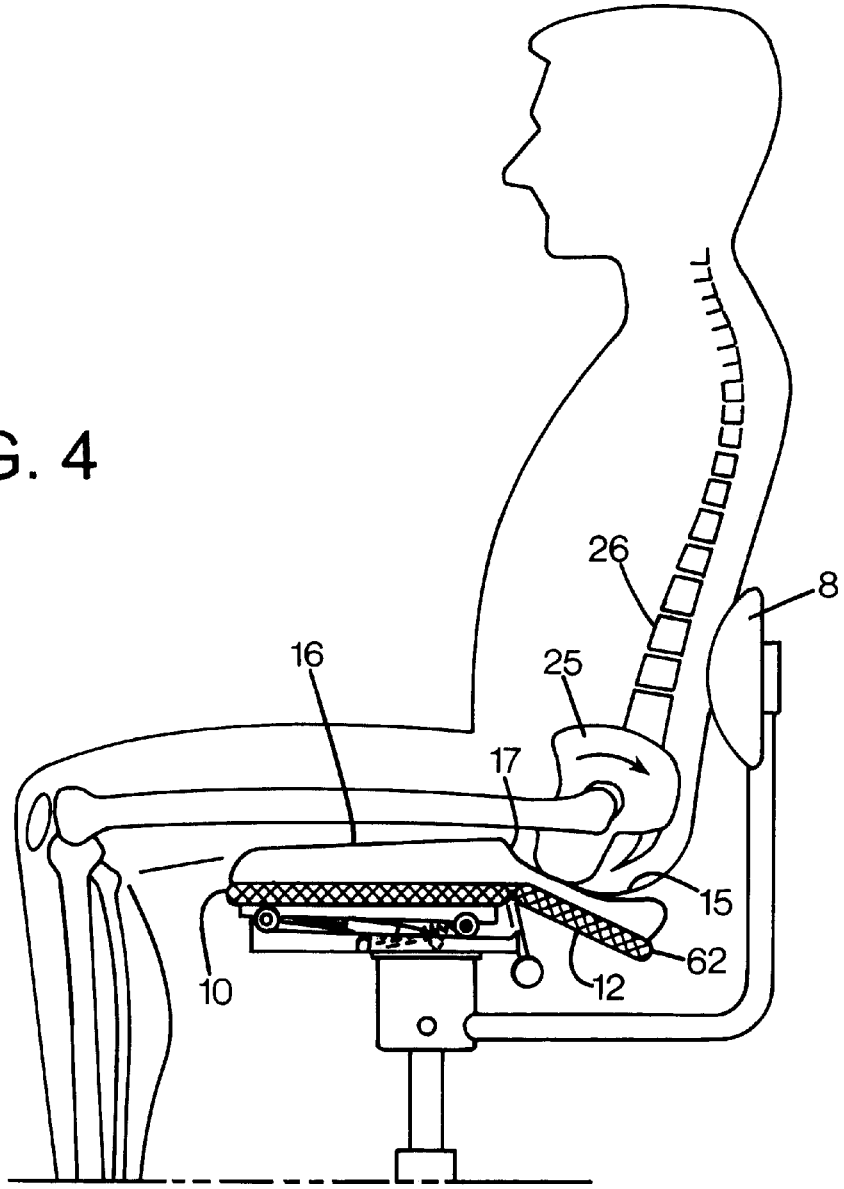
FIG. 4 is a side view showing the chair during use, wherein the seat is shown in a forward end position.
Figure 5:
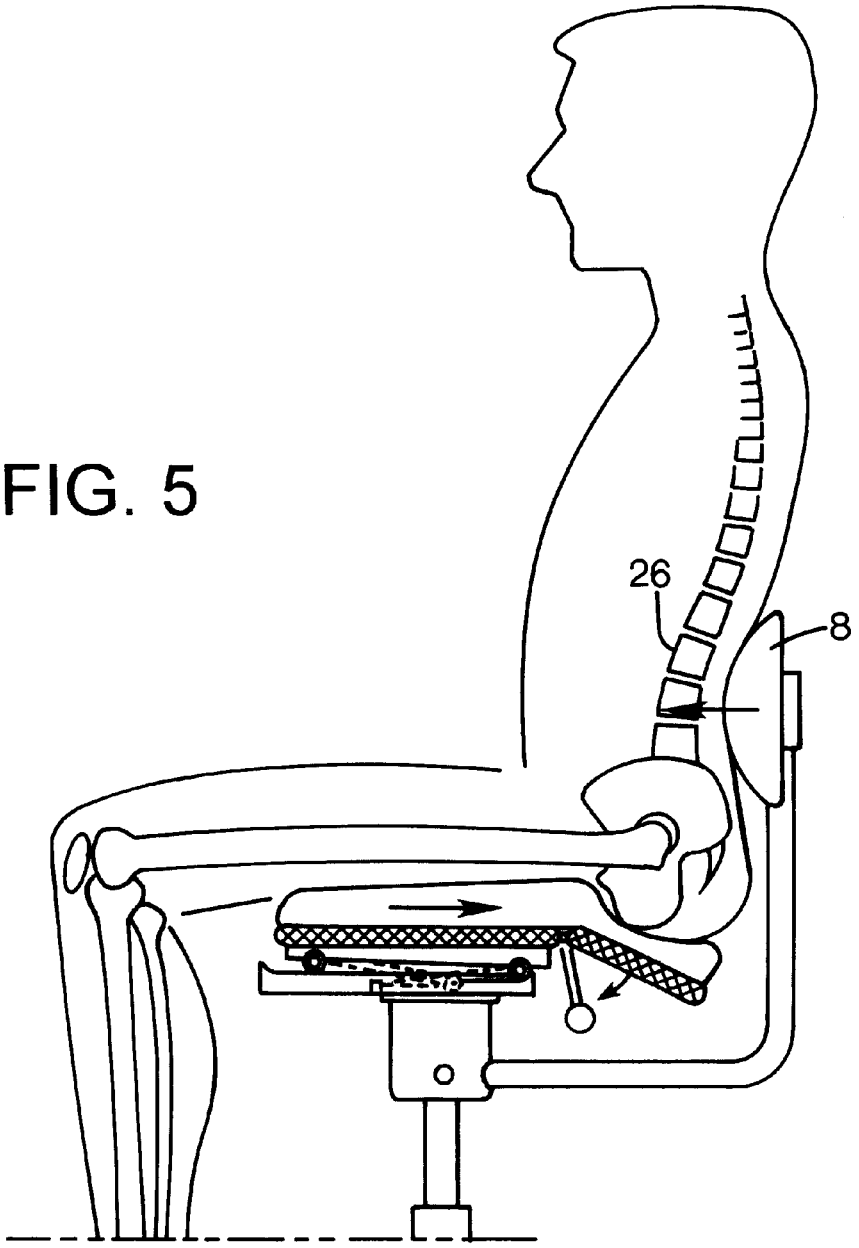
FIG. 5 is an analog side view of FIG. 4 showing the same seat in a rearward end position.

With reference to FIGS. 4 and 5, the function of the chair of the present invention during use is illustrated. FIG. 4 shows the seat of the chair in the forward end position, that is, the position of the chair as long as the chair is not in use or just at the moment when the user sits down on the chair. FIG. 4 further shows bones 25 that are positioned above the rear disc part 12 and behind the transition area 17 disposed between the rear and front seating areas 15, 16. FIG. 4 also indicates how the spine 26 of the user does not satisfactorily press or bear against the lumbar support device 8 of the back support 2. This means that the support members do not provide the desired sway back of the spine 26.

FIG. 5 shows how the seat, after being automatically moved to the rear end position as a consequence of the weight of the person sitting on the chair, to ensure that the person's bottom and bones 27 are placed close to the back support in the rear position and below the lumbar support device 8 so that the lumbar support device 8 may, in a distinct and active way, support the lumbar spine/pelvis rim in an optimal ergonomical, sway back position.

In the embodiment shown in FIGS. 1–5, the sliding plane 21 and the spring or springs 23 together form a device that may perform three different functions. The first function is taken care of by the springs 23 by maintaining the seat in the forward starting position as long as the seat is not used (see FIG. 4). The other function is performed by the sliding plane 21 that automatically may carry out a relative movement between the seat 3 and the back support 8 when the user sits down on the seat 3. As shown in FIG. 5, the seat 3 may move backwardly from its forward starting position in a direction towards the stationary back support 8. The springs 23 may also perform a third function by returning the seat 3 to the forward starting position when the user leaves the seat 3.

Figure 6:
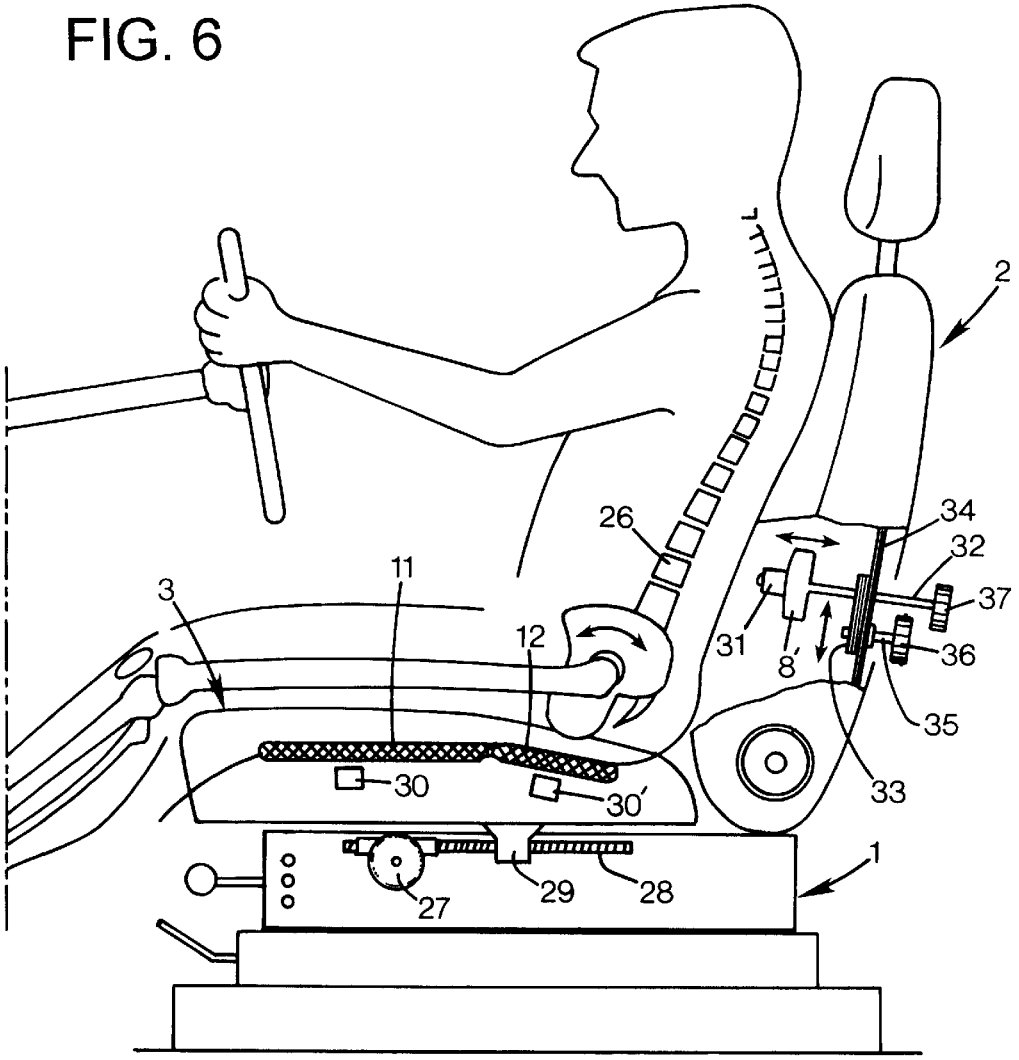
FIG. 6 is a side view illustrating a second embodiment of the invention, more particularly the use of the invention on a chair in the form of a vehicle seat wherein the seat of the chair is shown in a forward end position.
Figure 7:
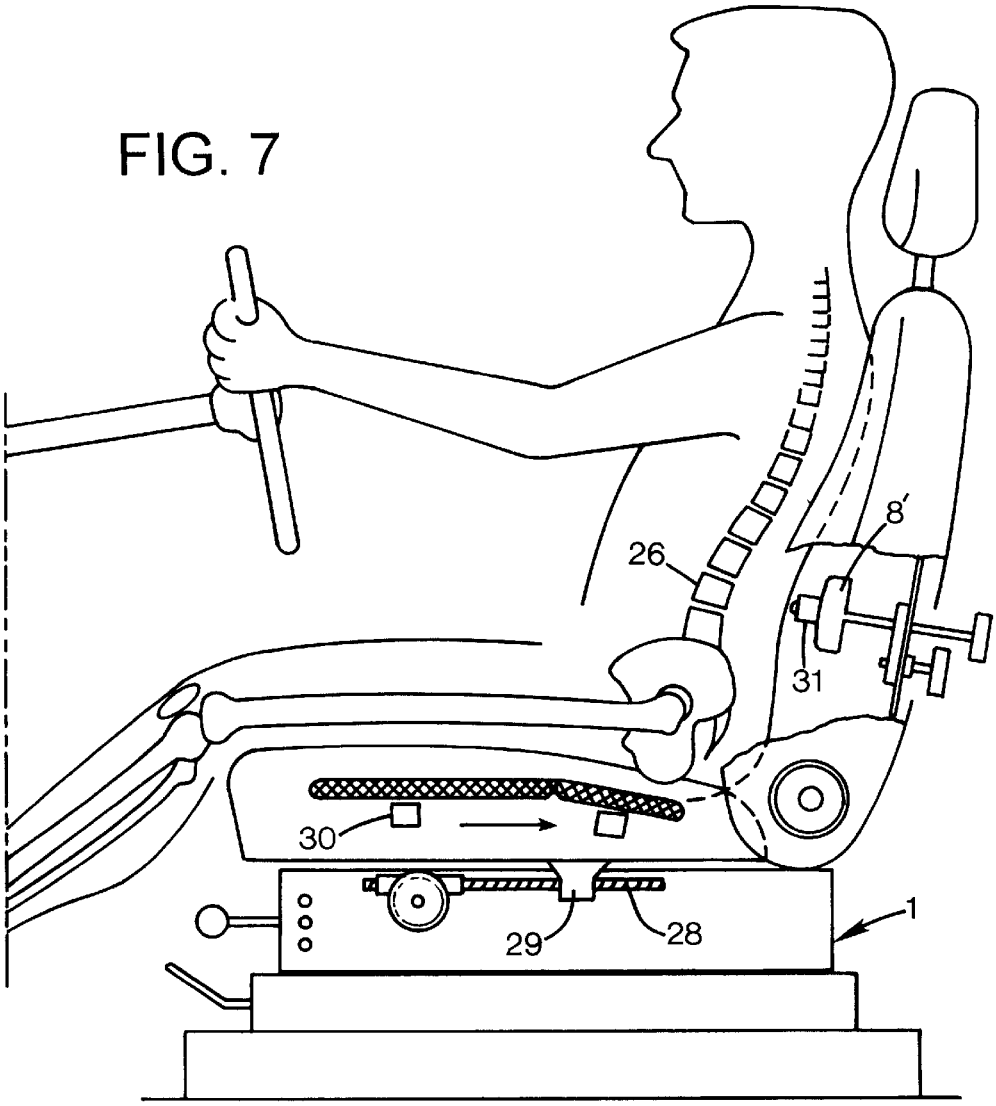
FIG. 7 is a side view corresponding to FIG. 6 showing the seat of the chair in a rear end position.

FIGS. 6 and 7 illustrate a second embodiment in which the invention may be applied in connection with a chair construction for vehicles, for example an automobile driver's seat. As described earlier, this driver's seat may also include a frame 1 that is attached to a back support 2 and a seat 3. Preferably, the seat 3 includes a support panel 10 that is, as described earlier, divided into front and rear parts 11, 12. In this case, the seat 3 is movable back and forth relative to the frame 1 and the back support 2. For example, the seat 3 may be moved from a forward starting position towards a back end position with the help of a motor 27, such as an electric motor that has a built in transmission. In the embodiment, the motor is secured to the frame 1 and cooperates with a rotatable screw 28 that has a nut 29 attached thereon, and the screw is attached to an underside of the seat 3 that is movable in a forward and backward direction relative to the frame 1 and the back support 2. In the illustrated embodiment, the seat 3 has at least one sensor that has the function of sensing whether anybody is sitting on the seat or not. Most preferred, two sensors 30, 30' are included in which the sensor 30 is disposed below the front disc part 11 while the sensor 30' is disposed below the rear disc part 12.

The back support 2 may include an additional sensor 31 that has the function of sensing whether the back of the user applies a certain pressure against the back support 2. More particularly, the sensor 31 is mounted on a lumbar support device 8' that is built into the back support 2. As described above, the device 8' may have the function of supporting the lumbar spine 26 of the user. In the illustrated preferred embodiment, the lumbar support device 8' may be adjustably movable between the desired positions both in height and lengthwise. In this way, the device 8' may be attached to a rotatable screw 32 that is in threaded cooperation with a holder plate 33. The plate 33 is, in turn, raisable and lowerable relative to a rigid member 34 that is included in the back support 2. More particularly, the plate 33 may be adjusted with an adjustment mechanism that is illustrated in the form of a shaft 35 having a control wheel 36. By manipulating this wheel, the plate 33, and thus the lumbar support device 8', may be adjusted to a desired height. By manipulating a second wheel 37 that is attached to the screw 32, the lumbar support device 8' may be adjusted lengthwise to a desired distance from the member 34 so that the lumbar support device 8' protrudes more or less into the back of the user.

When a person sits down on the seat 3, the first sensor 30, preferably, activates the motor 27 so that the screw 28 is brought to rotate to bring the seat in a direction from the front starting position to a rear end position. In practice, the initialization of the motor may be performed with a certain time delay (such as 5–10 seconds) to provide the best comfort. When the seat has been moved so far back in the backward direction towards the back support that the user's back applies a predetermined pressure against the sensor 31, the motor may stop operating so that the movement of the seat is terminated. The seat has then reached a rear end position in which the lumbar support device in a distinctive way is applied against the back of the user.

When the user, after the driving is completed, leaves the vehicle seat, the sensors 30, 31 (or another sensor, that is not shown, that is disposed in the back support or the seat) again activate the motor 27 so that the motor brings the screw to rotation in an opposite direction of rotation to bring the seat back to its forward starting position.

It is also possible to activate the motor 27 in other ways than with the help of one or many sensors as described above. Thus, the required relative movement between the seat and the back support may be accomplished by using the vehicle's own rolling movements, the seat belt buckle or by activating the ignition of the vehicle. The relative movement may thus be limited by the power of the motor 27 or by the rotation of the screw 28. Such solutions may make the construction less expensive but also less sensitive.

With reference to FIGS. 8–11, a third embodiment of the chair of the present invention is shown. More particularly, the chair is embodied as an office chair. The characteristic for this embodiment is that the movements of the seat 3 between the forward and rear end positions may be performed with the assistance of a number of links 38, 39 and by a piston cylinder mechanism in the form of a gas spring 40.

Figure 8:
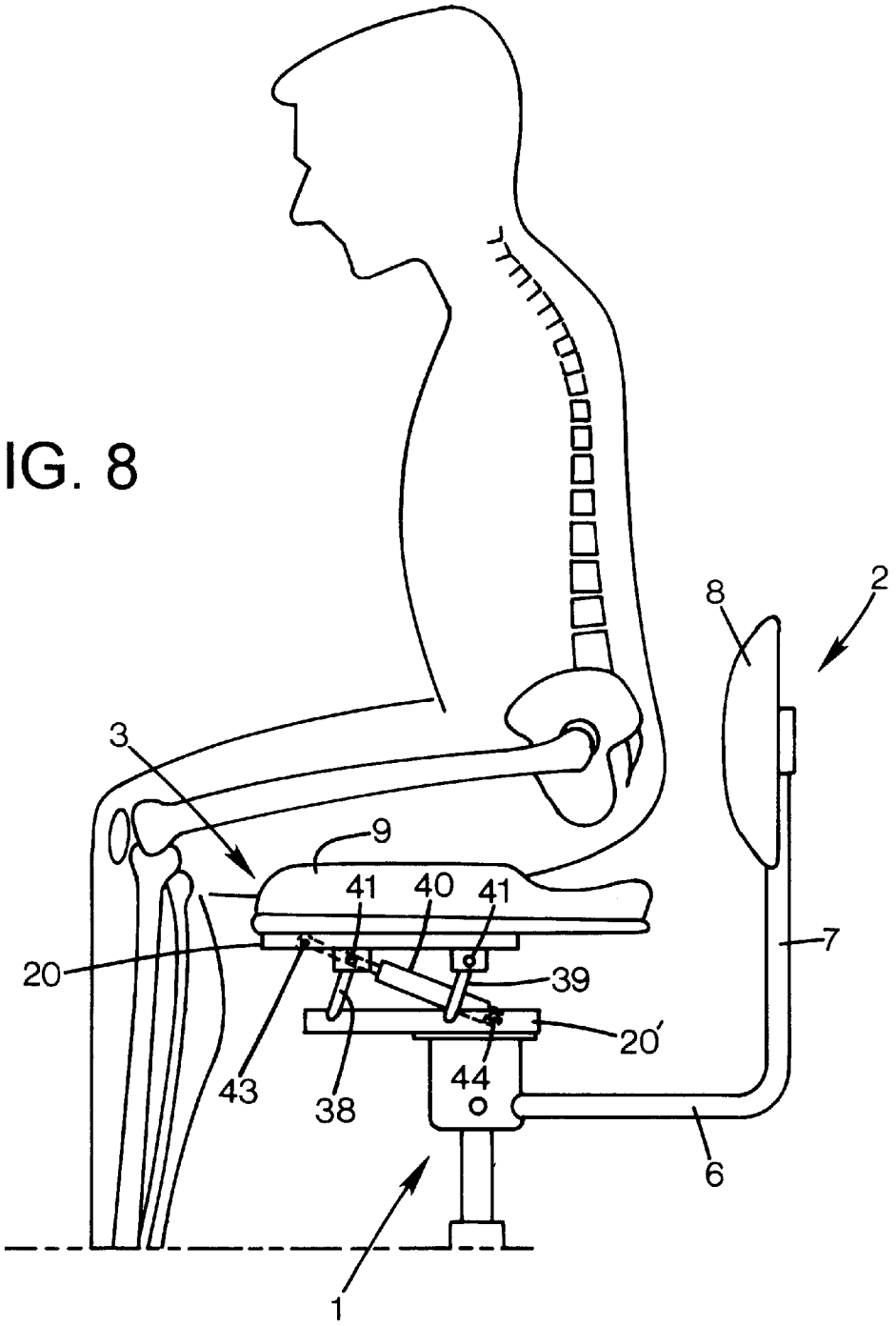
FIG. 8 is a side view showing a third embodiment of the chair in the form of an office chair, wherein the chair is shown in a position immediately before a user sits down on the seat of the chair.
Figure 10:
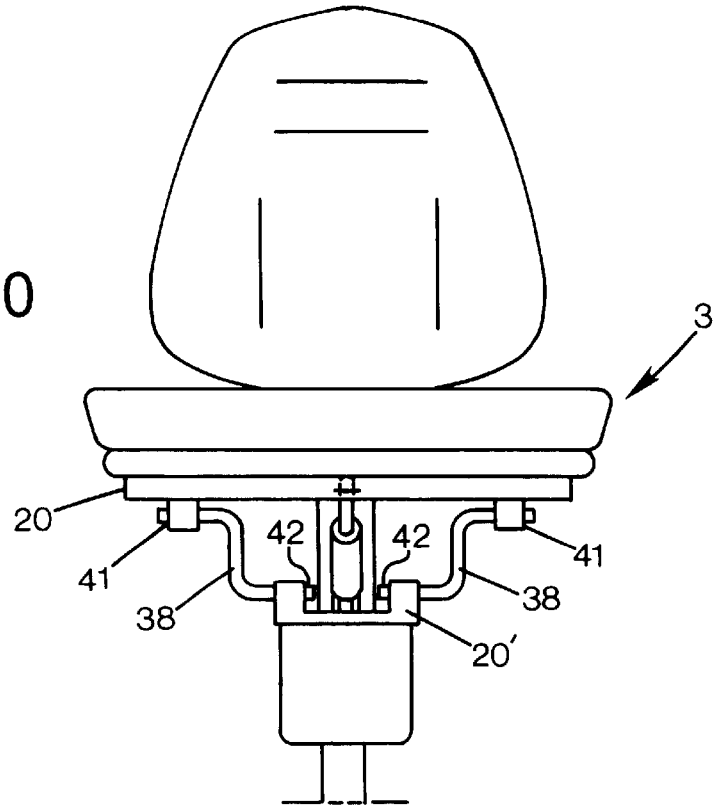
FIG. 10 is a front view showing the chair in the position according to FIG. 8.
Figure 11:
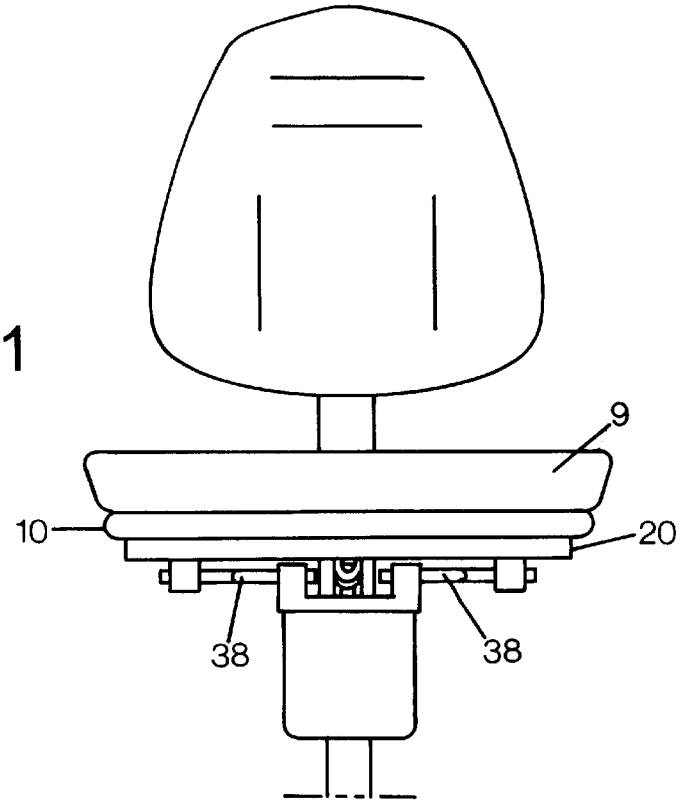
FIG. 11 is a front view showing the chair in the position according to FIG. 9.

More particularly, two links are in operative engagement with the seat and the frame. The links are each directly or indirectly pivotably attached to the seat and frame, respectively. As shown in FIG. 8 and 10, two forward, substantially Z-shaped links 38 are, via the upper link 41, attached to a unit 20 that functions as an attachment on the underside of the seat. In this way, the lower ends of the links are, via links 42, attached to a unit 20' that functions as an attachment and is included in the frame 1. In an analogous way, a rear pair of links 39 have their support ends attached to the unit 20 via the links 41 while at the same time, the lower ends are pivotally attached to the unit 20'. In the example, the piston member of the gas spring may be turned forwardly and the cylinder backwardly.

The gas spring 40 has a front end that is attached to the unit 20 via a link 43. The rear end is attached to the unit 20' via another link 44. As shown in FIG. 8, the front link 43 is disposed in an area that is at the front end of the seat 3 while the rear link 44 is disposed in an area that is at the back end of the unit 20'.

In the starting position that is shown in FIG. 8, the pair of links 38, 39 are positioned so that they point upwardly/rearwardly from the lower links 42 (preferably in a position "five minutes over twelve"). At the same time, the elongate and thin gas spring 40 is positioned in a position in which it points upwardly and forwardly at an angle from the rear link 44. In this position, the seat 3 is held a certain level above the unit 20' of the frame, more particularly with the help of the gas spring 40.

Figure 9:
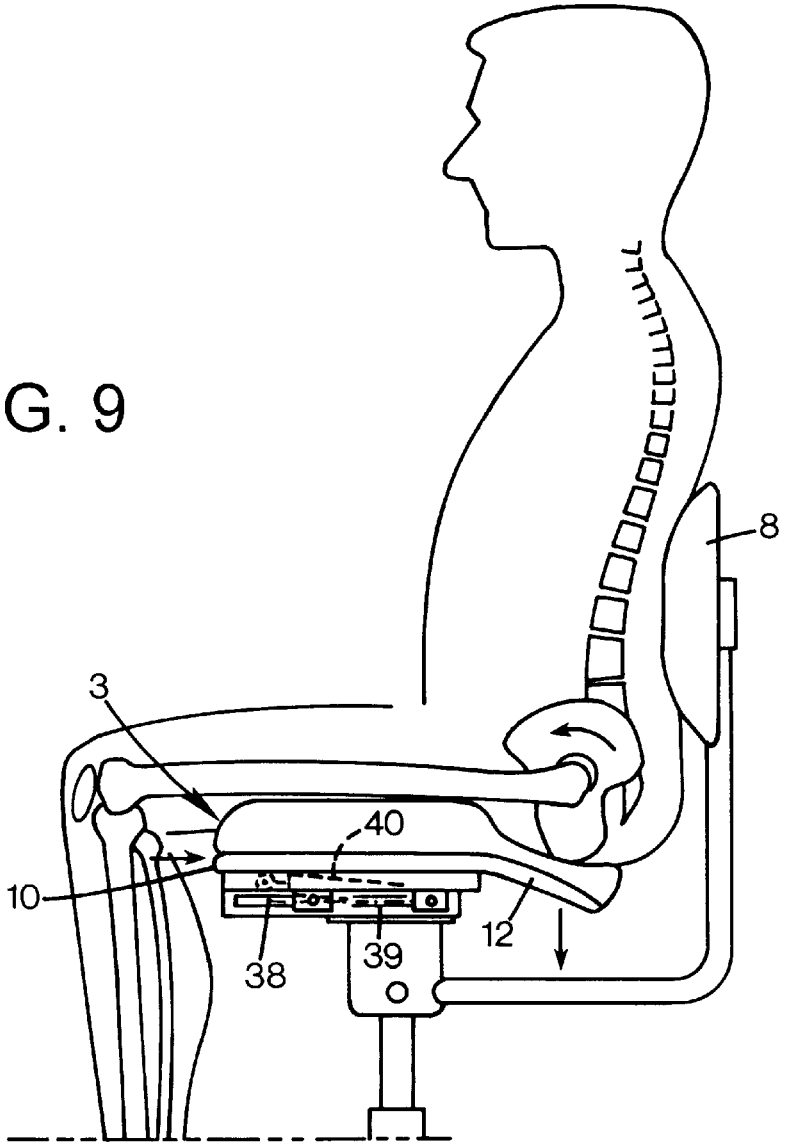
FIG. 9 is a side view showing the third embodiment in a position when a user has sat down on the seat and the seat has moved to a rear end position.

When a user sits down on the seat, as shown in FIG. 9, the pair of links will turn in a clockwise direction to a substantial collapsed horizontal position. More particularly, they will turn in a direction that is opposite the counter clockwise direction of the spring biased gas spring 40. Due to the geometry between the links and the gas spring, the gas pillow in the chamber of the gas spring is compacted so that a maximum pressure is achieved when the gas spring has been shortened to the position that is shown in FIG. 9.

As mentioned above, In this position, the links 38, 39 have been turned down to, for example, a substantially horizontal position in which there is still a certain difference in level between the front and back links 43, 44 of the gas spring. During the swinging movement of the links 38, 39, the seat 3 may be moved lengthwise in a backward direction so that the back of the user is pressed against the pillow of the lumbar support device 8 of the back support 2. At the same time, the bottom of the user is pressed rearwardly/downwardly to an area below the pillow 8.

According to the embodiment of FIGS. 8–11, the back part 12 of the support panel 10 includes a backwardly narrowing disc portion that is resiliently elastic to be bent and turned downwardly to the position that is shown in FIG. 9 when the user sits down on the seat.

The gas spring 40 not only keeps the seat in the front starting position as long the seat is not used but also returns the seat to this starting position when the user leaves the chair. In this way, the link pairs 38, 39 provides a means for discharging the seat in a rearward/downward direction when the user sits on the seat. It should be noted that the construction does not include any means for permanently locking seat in any of the two end positions. However, suitable locking devices could be provided as required.

It should also be noted that the gas spring 40 has a dampening effect in connection with the compacting of the gas pillow. In other words, the seat is moved at a controlled velocity not only in the direction towards its rear end position but also when it is returned to its front end position. The controlled velocity in the backward direction is important to prevent the user from being startled or uncomfortable when the seat moves backwardly.

An important advantage of the present invention is that the user automatically obtains a complete support for the back when he sits on the seat, that is, without having to intentionally push the his bottom in the direction towards the part of the back support that is disposed below the lumbar support device.

As described above, this can either be done in a simple mechanical way or by using the body weight of the user or with the help of a motor. In the particular case when the invention is used for vehicle seats the improved seating ergonomics results in a substantially reduced risk for back and neck pain during conventional driving over a long time period. During a front collision, the seat reduces, preferably in cooperation with a loaded seat belt stretcher, the risk for forward sliding compared to a conventional seat.

When hit from behind, the reduced distance between the back of the head of the user and the neck support of the back support provides for a lower risk for whip-lash injuries. This reduced distance between the back of the head and the neck support is the result of the improved body posture of the sitting person.

It should also be pointed out that the rear part of the support panel and the cushion, respectively, could be elastic in the downward direction when the belt stretcher is activated in connection with being hit from behind. This results in a reduced upward compression forces along the spine of the user and substances disposed around the spine. Such reduction of the compression forces in the spine are, in practice, an important factor for reducing whip-lash injuries when hit from behind.

The invention is not limited to the embodiments that have been described above and shown in the drawings. Thus, it is, for example, possible to use other means, than the wheels and rails of the type shown in FIGS. 1–5 and the links and gas springs shown in FIGS. 8–11, to provide an automatic movement of the seat in the direction towards the rear end position.

For example, sliding plates that have a low friction at the contact surfaces, such as plastic (type DELVIN) or such things, may be used. The generally backwardly sloping sliding plane that is required for the seat to move backwardly does not necessarily have to be plane or linear.

Therefore, the sliding plane can at least partially be bow shaped. In an alternative mounting of the link arms 38, 39, according to FIGS. 8–11, the links 42 may be disposed on a support arm that protrudes horizontally from the vertical post 7. The link arms may be mounted, as seen from the links 42, so that they are substantially horizontal ("quarter to nine") in the forward starting position. In this starting position, the seat is held with the assistance of the gas spring according to FIGS. 8–11. When the cushion and the seat are used, the seat is activated in a bow shaped movement in the backward/downward direction towards the back support to a rear end position in which the link arms 38, 39 are pointing substantially vertically downwardly ("25 minutes to seven").

In this way, the backward movement may be slowed down towards the back support with the gas spring. Although the invention shown in the drawings is throughout exemplified by a seat that from a forward starting position is backwardly movable towards the back support, it is also possible to design the chair so that the back support moves forwardly from a rear starting position relative to a stationary seat.

One important feature according to the invention is thus that there is a relative movement between the seat, on the one hand, and the back support, on the other hand, and the attached frame. Theoretically, it is even possible to combine the backward movement of the seat with a forward movement of the back support from the front and rear starting positions, respectively.

The possibility of designing a stationary seat and back support and frame that are forwardly movable towards the seat from a rear starting position can be of particular interest in connection with the vehicle seat that was described in connection with FIGS. 6 and 7 because the seat can be adjusted to a desired distance from the pedals of the vehicle. In this case, the seat may be attached to a part that is under the frame 1 that can either be permanently affixed relative to the floor of the vehicle or adjustable in different positions relative to the floor. In this way, the frame 1 and the back support attached thereto are movable back and forth relative to the seat. More particularly, they are movable from a rear starting position towards a forward end position in which the sway back is achieved in the manner described. The motors may also be monitored with an electronic monitoring unit that provides a varied lumbar pressure which improves and makes disc nutrition in the spine easier.

As briefly mentioned above, another important function of the support panel 10 is that the downward movement of the support panel 10 at the time of the impact may reduce or prevent whiplash injuries. When a vehicle is hit from behind, the spine of the driver (or passenger) is subjected to both horizontally and vertically directed forces. As best shown in FIG. 12, at the moment of the rear impact a force $F_y$ is generated and the person is pressed into the back support 8. During the recovery when the spine at the chest level of the driver moves forward and is straightened out (while the head remains almost still), the body of the person tends to climb upwardly (ramping) in the chair and be subject to compression forces $F_t$. These forces may, for example, partly depend upon the backward sloping of the back support of the chair and the gravitational forces of the weight of the upper body and the head of the person.

Another reason is that the seat is often relatively stiff in the downward direction. The support panel 10 of the present invention may be provided with a lockable hinge mechanism 90 that is secured with a pin 92 that may be either broken or torn away by an explosion means connected to the pretensioner of the seat belt mechanism. The explosion means may, in turn, be set to be triggered when the vehicle is subjected to a violent impact. By tearing away the pin 92, the support panel 10 and, thus, the cushion 9 is free to swing downwardly about the hinge mechanism 90 to remove most of the upwardly directed compression forces $F_t$ on the driver. Additionally, the seat belt may also pull the driver downwardly to counteract the downwardly oriented compression forces Ft.

During a head-on collision, the downward compression forces on the body during the impact against the seat belt anti-submarine protection in the front part of the seat may be as high as 30 g, the hinge mechanism 90 substantially reduces the counter acting forces by providing a gradual resistance. The increased downward angle of the support panel 10 also increases the friction forces and makes it more difficult for the bottom of the person to slide forwardly.

As best shown in FIG. 13, the amount of backward force $F_r$ that the sitting person may be subjected to as the person sits down may be adjusted. The backward force $F_r$ partly depends upon the weight (gravitational force $F_g$) of the sitting person if the backward movement of the seat is a function of the gravitational forces of the sloping surface 22. This means that a heavier person will move backwardly quicker than a very light person.

The gas piston 26 may be attached to the member 20 at an upper attachment point 94 to provide a relatively high backward force Fr at an angle alpha relative to a horizontal plane 95. By lowering the attachment point of the piston 26 to, for example, an attachment point 96 at a greater angle beta relative to the horizontal plane 95, the backward force $F_r$ is reduced as a result of the increase in the upwardly directed force $F_c$ that counteracts the gravitational force $F_g$. This means that the attachment point 96 may be more suited for a relatively heavy person or for a light person that only desires a slow backward movement or no backward movement at all.

Of course, the resistance of the piston 26 may also be adjusted without changing the position or angle of the attachment points of the piston 26. For example, the piston 26 may have an adjustment mechanism to adjust both the dampening and return forces of the piston.

FIG. 14 shows an alternative embodiment of a seat 112 having a left side 114 and a right side 116. This embodiment is identical to the earlier embodiments described above with the exception of the seat 112. In other words, the seat 112 may be moved towards the back support 108 as described above. Additionally, the user may then turn sideways on the seat 112 by either moving the left side 114 back and forth relative to the right side 116 or vice versa. The result is that the user may rotate the pelvis slightly in a forward/rearward direction relative to the back support of the chair to reduce fatigue of the spine and back muscles. The above described movements and actions of the seat parts is due to the users own body weight. In a car, these movements of the seat parts can be controlled by one or several electronically controlled motors. This is particularly important in a car seat when the driver sits on the seat for a long time. The result is similar to a conventional office chair that may be rotated about a vertical support stand relative to the back support.

It should be mentioned that the backward movement of the seat 3 may be triggered by ignition of the car, the seat belt buckle or by the forward or backward movement of the vehicle. Other means for triggering the backward movement of the seat 3 may be used, whether automatic or manual.

Furthermore, it is possible to design the chair with a seat 3 that is adjustable in different angles relative to the movable unit 21 of the frame. In such case, the seat is provided with a geometrical hinge axle that is disposed adjacent to the front edge thereof so that the front disc part of the seat is provided with a device for raising and lowering the rear edge of the front disc part. This embodiment is particularly suitable for so called "stand-support" sitting and requires a higher seat height and a more open hip angle compared to conventional sitting. The chair may also be provided with a rocking or tilt function for work that requires a backward sloping body posture, for example speaking on the phone or reading separate papers. In this body position the weight of the body will partially be transferred from the seat to the back support. The reduced seat pressure will make it possible to slide the seat forward relative to the back support while remained seated. This will open up the hip angle. When the seated person returns to an up-right seated position, the seat will automatically slide towards the back support as soon as the weight of the body returns to the seat.

While the present invention has been described in accordance with preferred compositions and embodiments, it is to be understood that certain substitutions and alterations may be made thereto without departing from the spirit and scope of the following claims.

I claim:

1. A chair for seating a person who has a pelvis, comprising:

a frame;

a seat disposed above the frame;

an upwardly protruding back support disposed in an area adjacent to the seat;

a lumbar support positioned a level above the seat to support the pelvis of the person;

the seat and the frame being movable relative to one another between a first position and a second position; and the frame comprising shifting means for holding the seat in the first position, in which the seat is remote from the back support and which is a position of the seat when nobody sits on the seat, and for activating a relative movement of the seat towards the second position in which the seat and the back support are closer together and for bringing the pelvis of the person sitting on the seat to partially shift and be disposed below the lumbar support and for automatically returning the seat towards the first position when the person sitting on the chair leaves the chair.

2. The chair according to claim 1 wherein the shifting means includes a motor.

3. The chair according to claim 1 wherein the member comprises a sliding track that is attached to the frame, the sliding track slopes in a backward/downward direction so that the seat automatically moves towards the second position when the seat is subjected to the load, the member also comprises a spring to spring bias the seat to move to the first position when the load on the seat is removed.

4. The chair according to claim 1 wherein a first link extends between the seat and the frame and a second link extends between the seat and the frame, a spring is pivotally attached to the seat and the frame so that the spring is biasing the seat away from the back support when the load is removed from the seat.

5. The chair according to claim 1 wherein the chair further comprises a delay mechanism for delaying movement of the seat from the first position to the second position a first time period after the seat is subjected to a load and for providing a controlled velocity of movement of the seat between the first and second position.

6. The chair according to claim 1 wherein the seat comprises a cushion and a support panel that is supported by the frame, the support panel comprises a front section and a rear section, the front section is attached to and supported by the frame and the rear section protrudes outwardly as a free end from the front section without being in direct contact with the back support, the cushion has a rear seating area that is recessed relative to a front seating area of the cushion, the cushion has a transition area disposed between the rear seating area and the front seating area so that the front seating area is disposed above the rear seating area, the rear section is lowerable from an upper starting position relative to the back support.

7. The chair according to claim 6 wherein the rear part is movable in a downward direction towards the frame.

8. The chair according to claim 6 wherein the transition area is disposed in an area that is above a zone that separates the front part from the rear part.

9. The chair according to claim 6 wherein an upper side of the cushion is covered with a cover that provides a high resistance against sliding in a forward direction and a low resistance against sliding in an opposite rearward direction.

10. The chair according to claim 1 wherein the chair has a lumbar support device positioned a first level above the seat.

11. A chair comprising:

a frame;

a seat disposed above the frame;

shifting means having one end connected to the frame and an opposite end connected to the seat;

an upwardly protruding back support adjacent to the seat;

the seat and the frame being movable relative to one another between a first position and a second position, the seat being remote from the back support in the first position and adjacent to the back support in the second position; and a member in operative engagement with the seat for holding the seat in the first position, for moving the seat to the second position when the seat is subjected to a load, and for returning the seat to the first position when the load is removed from the seat, the member including a motor, wherein the chair further comprises a first sensor and a second sensor in operative engagement with the chair, the first sensor being adapted to sense when the seat is subjected to a load and to activate the motor to move the seat and the back support towards one another, the second sensor is adapted to terminate the motor when the second sensor senses that the back support is subjected to a back load.

12. A method of operating a chair, comprising:

(a) providing a chair having a back support and seat supported by a spring member in operative engagement with the seat and a frame, the seat being connected to the frame by a connector assembly and the seat having a first side section movable relative to a second side section, the first and second side sections being supported by the frame;

(b) maintaining the seat in a first position being remote from the back support;

(c) subjecting the seat to a first load;

(d) rotating the spring member about an attachment attached to the frame; and (e) while rotating the spring member in step (d) moving the seat towards the frame and shifting the seat from the first position to a second position adjacent to the back support and shifting the first side section away from the back support and moving the first side section relative to the second side section.

13. The method according to claim 12 wherein the method further comprises moving the first side section away from the back support while moving the second side section towards the back support.

14. The method according to claim 12 wherein the method further comprises removing the first load from the seat and shifting the seat from the second position to the first position.

15. The method according to claim 12 wherein the method further comprises shifting the first side section towards the back support relative to the second side section.

16. The method according to claim 12 wherein the method further comprises generating a force with an electronically controlled motor to shift a portion of the seat towards the back support.

17. The method according to claim 12 wherein the method further comprises using a gravitational force to shift a portion of the seat towards the back support.

18. A method of operating a chair, comprising:

(a) providing a chair having a back support and seat supported by a frame;

(b) maintaining the seat in a first position being remote from the back support;

(c) subjecting the seat to a first load;

(d) a first sensor disposed in the seat sensing the first load;

(e) the first sensor sending a start signal to a motor in operative engagement with the seat to move the seat towards the back support;

(f) subjecting the back support to a second load;

(g) a second sensor disposed in the back support sensing the second load; and (h) the second sensor sending a stop signal to the motor to stop moving the seat towards the back support.

19. The method according to claim 18 wherein the method further comprises adjusting a lumbar support disposed in the back support.

20. The method according to claim 18 wherein the method further comprises providing the seat with a first side section that is movable relative to a second side section and shifting the first side section away from the back support and moving the first side section relative to the second side section.

21. The method according to claim 20 wherein the method further comprises shifting the first side section towards the back support.

22. The method according to claim 18 wherein the motor in step (e) is an electronically controlled motor that generates a force to shift a portion of the seat towards the back support.

23. The method according to claim 18 wherein step (e) further comprises using a gravitational force to shift a portion of the seat towards the back support.

* * * * *